United States Patent [19]

Sakai et al.

[11] 4,001,145

[45] Jan. 4, 1977

[54] GLASSY RESISTOR COMPOSITION FOR USE IN A RESISTOR INCORPORATED SPARK PLUG

[75] Inventors: Masao Sakai, Kasugal; Masaru Fukuoka, Aichi; Katsuyoshi Hayashi, Nagoya, all of Japan

[73] Assignee: NGK Spark Plug Co., Ltd., Nagoya, Japan

[22] Filed: Nov. 18, 1974

[21] Appl. No.: 524,733

[30] Foreign Application Priority Data

Nov. 21, 1973 Japan ..... 48-130065

[52] U.S. Cl. ..... 252/513; 252/516; 252/514

[51] Int. Cl.[2] ..... H01B 1/02; H01B 1/04; H01C 1/02; H01C 1/04

[58] Field of Search ..... 252/514, 512; 106/46

[56] References Cited

UNITED STATES PATENTS

| | | | |
|---|---|---|---|
| 3,484,284 | 12/1969 | Dates et al. | 252/513 |
| 3,680,029 | 7/1972 | Berry | 252/513 |
| 3,875,477 | 4/1975 | Fredicksson et al. | 252/516 |

*Primary Examiner*—Benjamin R. Padgett
*Assistant Examiner*—Josephine Lloyd
*Attorney, Agent, or Firm*—Stevens, Davis, Miller & Mosher

[57] ABSTRACT

A glassy resistor composition for use in a resistor incorporated spark plug is prepared by mixing 100 parts by weight of a mixture of 1–40% by weight of at least one of semiconductible oxides of metals selected from groups IVa and Va of the Periodic Table and a group of rare earth metals, 35–85% by weight of a glass powder and 5–35% by weight of a metal powder after a calcination, drying the resulting mixture, calcining the dried mixture and granulating the resulting mixture to form a base component, and compounding 100 parts by weight of the formed base component with 0.1–30 parts by weight of at least one of powdery carbides serving as reducing agents for the oxides and 0.1–20 parts by weight of inorganic or organic binder.

5 Claims, No Drawings

GLASSY RESISTOR COMPOSITION FOR USE IN A RESISTOR INCORPORATED SPARK PLUG

The present invention relates to a glassy resistor composition for use in a resistor incorporated spark plug.

A conventional resistor material used in a resistor incorporated spark plug for suppressing noises or radio frequency interferences are mainly made from a glass-aggregate-carbon system, however such a carboniferous resistor obtained from the system has bad adhesive properties with respect to the terminal electrode and the spark discharge electrode consisting of Ni, Fe, Cu or the like so that a conductive glass (copper powder:-glass=1:1) is usually used to seal and connect the resistor to the electrodes in the center bore of the insulator of the spark plug.

The conductive seal glass occupies a space in the center bore of the spark plug insulator together with the resistor and as a result this makes the length of the resistor rather short. Therefore the length of the insulator bore must be disadvantageously elongated, if effective suppression of the radio frequency interferences or noises is desired because such suppression is very well attained when the resistor is more than 7 mm in length as described in the Japanese laid open Japanese patent specification No. 45,725/73.

An object of the present invention is to eliminate such a problem as mentioned above, by providing a new glassy resistor composition for use in a resistor incorporated spark plug, having excellent adhesion to the terminal and the discharge electrodes.

Another object of the present invention is to provide a new glassy resistor composition which can perform three functions in sealing of the terminal and discharge electrodes, i.e. as an auxiliary resistor inserted between the resistor and the terminal and discharge electrodes to seal and connect them, as a resistor per se inserted between the terminal electrode and the center electrode to directly connect them without a conductive glass seal, and as a resistor capable of being used with a conductive glass seal.

According to the present invention a glassy resistor composition for use in the resistor incorporated spark plug is formed by mixing 100 parts by weight of a mixture consisting of 1–40% by weight of at least one of semiconductible oxides of metals selected from groups IV*a* and V*a* of the Periodic Table and a group of rare earth metals, 35–85% by weight of a glass powder and 5–35% by weight of a metal powder, and 0.1–30 parts by weight of at least one powdery carbide serving as reducing agents for said oxides.

According to the present invention, a semiconductive material found in the present resistor which exhibits excellent compatibility to the center electrode, the terminal electrode and/or the glass seal is a partly reduced resultant of at least one of semiconductible oxides of metals selected from groups IV*a* and V*a* of the Periodic Table and a group of rare earth metals. Such oxides are $TiO_2$, $Nb_2O_5$, $ThO_2$, and $La_2O_3$, and the like. The glass powder is preferably a borosilicate series glass, particularly, a $SiO_2.B_2O_3$ series glass comprising 65% by weight of $SiO_2$, 30% by weight of $B_2O_3$ and 5% by weight of PbO. The metal powder is one of Cu, Ag, Mn, Cr, Fe and/or an alloy such as FeB.

The glassy resistor composition in accordance with the invention comprises 100 parts by weight of a base component and 0.1–30 parts by weight of a reducing agent. The base component consists of 1–40% by weight of the metal oxide, 35–85% by weight of the glass powder and 5–35% by weight of the metal powder.

When an amount of the metal oxide is less than 1% by weight the heating property and the durable life property under load of the obtained resistor become unsatisfactory and when the amount of the metal oxide is more than 45% by weight the softening point of the resistor composition becomes high and the wettability thereof to the discharge and/or the terminal electrode becomes poor and the heating property becomes inferior.

When the amount of the glass powder is less than 35% by weight the resultant resistor is porous or gas-tightless and the apparent softening point becomes so high that it is difficult to insert the terminal electrode into the center bore of the insulator at the normal sealing temperature, and when the amount of the glass powder is larger than 85% by weight the resistance value of the resistor obtained varies considerably and the heating property becomes worse.

When the amount of the metal powder is less than 5% by weight the heating property becomes unsatisfactory and the effect of addition of metal powder cannot be attained. When the amount of the metal powder is larger than 35% by weight the resistance value of the resistor becomes so small that the function of the resistor cannot be exhibited. Therefore, the amount of the metal powder should be in a range of 5–35% by weight.

The carbide which acts as a reducing agent contributes to partial reduction or semiconduction of the metal oxide constituting the resistor and is added in the percentage of 0.1–30 parts by weight based on 100 parts by weight of the above mentioned base component.

The carbide which may be used alone or admixed is TiC, $B_4C$, SiC, TaC or the like.

When the amount of the carbide is less than 0.1 parts by weight its function as the reducing agent is weak and the resistance value of the resulting resistor becomes too large and variant so that it is difficult to use the resistor in practice, and when the amount of the carbide is more than 30 parts by weight the conduction effect of the carbide itself appears too conspicuous in the resistor and the resistance value of the resistor becomes too small so that the obtained resistor cannot be used as a resistor.

The above described resistor composition which is filled in the center bore of the insulator is made by mixing the raw powder materials in a wet process, and drying the mixed materials. In this case the filling operation of the materials will be easily fulfilled if all the materials are ground on the order of 20–100 meshes.

Moreover, it is desirable to add based on 100 parts by weight of the base component, 0.1–20 parts by weight of the organic or inorganic binder to the mixed material, in addition to 0.1–30 parts by weight of the carbides. This addition of the binder can realize a uniform mixing and effectively prevent the mixed materials (particularly metal powder) from separating from each other in the mixing process.

The advantageous effect of the addition of the binder appears in a range between the above extreme limitations, but in case of exceeding the above upper limit the heating property of the obtained resistor and the durable life property under load are soon damaged so that it is preferable to limit the amount of the binder less than 20 parts by weight.

As is later explained in the embodiment the mixed raw powder thus obtained is filled halfway in the center bore of the spark plug insulator and pressed between the discharge electrode and the terminal electrode under heating so as to form a sealed resistor together with reduction of the oxide powder.

"The heating property of the spark plug incorporating resistor" is herein defined by the following variation percentage value. The resistance value of the resistor sandwiched between the electrodes is firstly determined at room temperature and then the spark plug is subjected to 400° C for 15 minutes in the air and then left to stand for 30 minutes at room temperature, thereafter the resistance value is again measured, the values are compared and the variation percentage therebetween is calculated. "The durable life property under load" means the variation percentage determined after its use of 250 hours on the spark test under the conditions defined in JIS D5102, 4,4,11.

A preferred experimental embodiments of the present invention will be explained in the following detailed description.

At first a conventional carbonaceous or carboniferous resistor material is prepared by calcining at 800°–1,300° C the mixture of 28 parts by weight of barium borate glass ($BaO:B_2O_3$=35:65), 23 parts by weight of zircon, 4 parts by weight of glycerin (carbonaceous) and 48 parts by weight of clay and by pulverizing the calcined mixture.

Secondly, in order to seal the carbonaceous resistor material to the spark discharge electrode and the terminal electrode, the glassy auxiliary resistor material according to the present invention is prepared by mixing in a wet state 60 parts by weight of a lead borosilicate glass powder consisting of 30% by weight of $B_2O_3$, 65% by weight of $SiO_2$ and 5% by weight of PbO, 20 parts by weight of $TiO_2$ powder, 20 parts by weight of Cu powder, (base component), 5 parts by weight of TiC powder (reducing agent) and 10 parts by weight of clay (binder) and by granulating the resulting mixture on the order of 60 meshes after drying.

In assembling, at first into a center bore (inner diameter: 4.6 mm, length: 49.5 mm) of the spark plug ceramic insulator is firstly inserted from the top end thereof a flanged spark discharge electrode having an outer diameter of 2.8 mm, the flange thereof being held on the inner shoulder of the insulator and the other end thereof being projected from the lower end of the insulator. The present glassy auxiliary resistor material is then filled on the flange of the center electrode in a height of 3 mm and then the above described resistor raw material is superimposed thereon in a height of 11 mm, thereafter the same auxiliary resistor material as described above is further superimposed thereon in a height of 4 mm. Then the ceramic insulator is heated at 970° C for 7 minutes to soften these materials therein and then the terminal electrode having an outer diameter of 4.5 mm is forced down into the center bore from the top end of the insulator bore under a pressure of 12 $Kg/cm^2$, thereby the spark plug having the carbonaceous resistor of 6 mm in length and the auxiliary resistors each of 1 mm in length sealed in the insulator bore is obtained.

It is found that the sample of the thus obtained spark plug has excellent properties such as the heating property of +1.5 – +3.5% and the durable life property under load of −15 – −5%.

Changing the metal powder in the above base component, the heating characteristic and the durable life property under load are determined in the same manner to obtain the results as shown in Table 1.

Table 1

| $TiO_2$ (parts by weight) | Lead borosilicate glass (parts by weight) | TiC (parts by weight) | Metal powder (parts by weight) Cu | Fe | Mn | Cr | Ag | FeB | Heating property (%) 400° C/15min. | Durable life property under load (%) |
|---|---|---|---|---|---|---|---|---|---|---|
| 20 | 60 | 5 | 20 | | | | | | +1.5 – +3.5 | −13 – −5 |
| 20 | 60 | 5 | | 20 | | | | | +1.5 – +3.5 | −20 – −14 |
| 20 | 60 | 5 | | | 20 | | | | +0.5 – +4.5 | −6 – +15 |
| 20 | 60 | 5 | | | | 20 | | | +4 – +11 | +3 – +13 |
| 20 | 60 | 5 | | | | | 20 | | +8 – +20 | −4 – +5 |
| 20 | 60 | 5 | | | | | | 20 | +1.0 – +3.5 | −5 – −1 |
| 20 | 60 | 5 | 10 | | | | | 10 | +1.5 – +4.5 | −8 – −3 |
| 20 | 60 | 5 | | 10 | | 10 | | | +11 – +15 | −20 – +14 |
| 20 | 60 | 5 | | | | | 5 | 15 | +3.5 – +5.0 | −5 – +1 |

Similarly, changing the oxide in the base component the heating characteristic and the durable life property under load are determined to obtain the results as shown in Table 2.

Table 2

| Lead borosilicate glass (parts by weight) | Metal powder Cu (parts by weight) | TiC (parts by weight) | Oxide (parts by weight) $TiO_2$ | $Nb_2O_5$ | $Ta_2O_5$ | $ThO_2$ | $La_2O_3$ | Heating property (%) 400° C/15min. | Durable life property under load (%) |
|---|---|---|---|---|---|---|---|---|---|
| 60 | 20 | 5 | 20 | | | | | +1.5 – +3.5 | −13 – −5 |
| 60 | 20 | 5 | | 20 | | | | +8 – +15 | −7 – +5 |
| 60 | 20 | 5 | | | 20 | | | +4.5 – +10 | −11 – +3 |
| 60 | 20 | 5 | | | | 20 | | +5 – +8.5 | −13 – +5 |
| 60 | 20 | 5 | | | | | 20 | +7 – +10 | −10 – −3 |
| 60 | 20 | 5 | 10 | 10 | | | | +2.5 – +6.5 | −14 – −5 |
| 60 | 20 | 5 | 15 | | | | 5 | +2.5 – +8.0 | −10 – −6 |
| 60 | 20 | 5 | | | 10 | 10 | | +5.5 – +13 | −5 – +4 |

The results obtained changing the kind of the carbide are shown in Table 3.

Table 3

| $TiO_2$ (parts by weight) | Lead boro-silicate glass (parts by weight) | Metal powder Cu (parts by weight) | Carbide (parts by weight) TiC | $B_4C$ | SiC | TaC | Heating property (%) 400° C/15min. | Durable life property under load (%) |
|---|---|---|---|---|---|---|---|---|
| 20 | 60 | 20 | 5 | | | | +1.5 – +3.5 | −13 – −5 |
| 20 | 60 | 20 | | 5 | | | +3.5 – +6.0 | −3 – +1.5 |
| 20 | 60 | 20 | | | 5 | | +13 14 +25 | −7 – +11 |
| 20 | 60 | 20 | | | | 5 | +4.5 – +11 | −15 – −3 |
| 20 | 60 | 20 | 3 | | 2 | | +3.5 – +4.5 | −8 – −5 |
| 20 | 60 | 20 | | 2 | 3 | | +7.5 – +15 | −8 – −1 |

The results obtained with respect to the effect of adding the carbide to the same base component as above are shown in Table 4.

Table 4

| TiC (parts by weight) | Property: Heating characteristic (%) 400° C/15min. | Durable life property under load (%) |
|---|---|---|
| *0 | Impossible to use because of large variation of resistance value. | |
| 0.1 | +11 – +45 | −18 – −10 |
| 5 | +1.5 – +3.5 | −13 – −5 |
| 10 | +3.0 – +7.5 | −17 – −5 |
| 30 | +8.5 – +17.0 | −28 – −20 |
| *33 | Impossible to use because of too small resistance value. | |

*Not covered by the scope of the present invention.

Then, with respect to the various base components, the heating characteristic and the durable life property under load are determined within and without the scope of the present invention to obtain the results as shown in Table 5.

Table 5

| Sample | Lead boro-silicate glass | Metal powder Cu | $TiO_2$ | TiC | Heating property (%) 400° C/15min. | Durable life property under load (%) |
|---|---|---|---|---|---|---|
| | (Parts by weight) | | | | | |
| *1 | 82.5 | 2.5* | 15 | 10 | +58 – +150 | −13 – −5 |
| *2 | 80 | 20 | 0* | 10 | +28 – +35 | +35 – +50 |
| 3 | 80 | 19 | 1 | 10 | +13 – +18 | +15 – +25 |
| 4 | 80 | 5 | 15 | 5 | +18 – +30 | −15 – −8 |
| 5 | 70 | 30 | 10 | 5 | +3.0 – +8.0 | −10 – −3 |
| 6 | 70 | 10 | 20 | 5 | +4.5 – +11 | −13 – −1 |
| *7 | 67.5 | 2.5* | 30 | 5 | +45 – +75 | −18 – −3 |
| *8 | 65 | 34.5 | 0.5* | 10 | +29 – +55 | +31 – +55 |
| 9 | 64 | 35 | 1 | 10 | +15 – +20 | +10 – +23 |
| 10 | 60 | 30 | 10 | 5 | +1.5 – +4.5 | −10 – −5 |
| 11 | 60 | 10 | 30 | 5 | +8.0 – +11 | −18 – −10 |
| *12 | 55 | 0* | 45* | 5 | +150 – +230 | −11 – −3 |
| *13 | 50 | 37.5* | 12.5 | 5 | Impossible to use as resistor because of too small resistance value. | |
| 14 | 50 | 30 | 20 | 5 | +3.5 – +8.5 | −11 – −8 |
| 15 | 50 | 20 | 30 | 5 | +5.0 – +14 | −15 – −3 |
| *16 | 50 | 5 | 45* | 5 | +20 – +29 | −22 – −6 |
| *17 | 47.5 | 5 | 47.5* | 5 | +31 – +58 | −20 – −3 |
| 18 | 45 | 15 | 40 | 5 | +18 – +28 | −15 – −8 |
| 19 | 40 | 30 | 30 | 5 | +7.5 – +20 | −13 – −6 |
| 20 | 35 | 35 | 30 | 5 | +13 – +25 | −11 – +3 |
| *21 | 7 | 20 | 45* | 5 | +20 – +30 | −18 – −8 |
| *22 | 32.5* | 37.5 | 30 | 5 | Difficult to insert terminal electrode into center bore. | |
| *23 | 32.5* | 20 | 47.5* | 5 | Difficult to insert terminal electrode into center bore. | |

*Not covered by the scope of the present invention.

The above described embodiments prove that the present glassy resistor composition in accordance with the invention can seal and electrically connect the carbonaceous resistor to the discharge and terminal electrodes in the spark plug insulator bore and work as an auxiliary resistor cooperating with the carbonaceous resistor. And moreover, the present composition can also be applied as a resistor inserted between the terminal and discharge electrodes instead of the carbonaceous resistor without the conventional conductive glass.

The latter case above means that one resistor is only filled between the terminal and discharge electrodes in the center bore of the spark plug insulator so that the manufacturing process of the spark plug can be remarkably simplified.

The properties of the spark plug in which the glassy resistor composition in accordance with the invention is singly filled to a height of 17 mm in the center bore of the previously described spark plug and pressed in the similar manner are shown in Table 6.

Table 6

| Lead boro-silicate glass | $TiO_2$ | Metal powder | Carbide | Heating property (%) 400° C/15min. | Durable life property under load (%) | Resist-ance value |
|---|---|---|---|---|---|---|
| 60 | 20 | Cu 20 | TiC 1 | +11 – +24 | −11 – −25 | 1.5 KΩ |
| 60 | 10 | Fe B30 | SiC 8 | +9 – +28 | −3 – −14 | 1.7 KΩ |

The glassy resistor composition according to the present invention may be used with conductive glass seals which have been commonly used to sandwich the conventional carbonaceous or any resistor, if necessary.

The properties of the resistor incorporated spark plug in which the present glassy resistor composition is inserted to a height of 11 mm with conductive glass seals (Cu:glass=1:1) in the insulator and pressed in the similar manner as previously described, are shown in Table 7.

Table 7

| Lead boro-silicate glass | $TiO_2$ | Metal powder | Carbide | Heating property (%) 400° C/15min. | Durable life property under load (%) | Resist-ance value |
|---|---|---|---|---|---|---|
| 60 | 20 | Cu 20 | TiC 1 | +1.5 – +3.5 | −8 – −16 | 1.0 KΩ |
| 60 | 10 | Fe B30 | SiC 8 | +1.5 – +3.5 | −5 – −11 | 1.3 KΩ |

According to the present invention the properties of the resistor of the resistor incorporated spark plug such as the heating property and the durable life property under load are remarkably stable and even improved.

What is claimed is:

1. A glassy resistor composition for use in a resistor incorporated spark plug formed by mixing 100 parts by weight of a mixture of 1–40% by weight of at least one semiconductible oxide selected from group consisting of $TiO_2$, $Nb_2O_5$, $ThO_2$ and $La_2O_3$; 35–85% by weight of a glass powder; and 5–35% by weight of at least one metal powder selected from group consisting of Cu, Ag, Mn, Cr, Fe and an alloy of FeB; with 0.1–30 parts by weight of at least one powdery carbide selected from the group consisting of TiC, $B_4C$, SiC and TaC; serving as a reducing agent for said oxides.

2. A glassy resistor composition as claimed in claim 1, further comprising 0.1–20 parts by weight of an inorganic or organic binder based on 100 parts by weight of said mixture.

3. A glassy resistor composition as claimed in claim 1, wherein said glass powder comprises a borosilicate series glass.

4. A glassy resistor composition as claimed in claim 3, wherein said glass powder comprises a $SiO_2$, $B_2O_3$ glass.

5. A glassy resistor composition as claimed in claim 4, wherein said glass powder consists of 65% by weight $SiO_2$, 30% by weight $B_2O_3$ and 5% by weight PbO.

* * * * *